US007507113B2

(12) United States Patent
Aida et al.

(10) Patent No.: US 7,507,113 B2
(45) Date of Patent: Mar. 24, 2009

(54) WIRE HARNESS ASSEMBLY ASSIST PROGRAM

(75) Inventors: Tetsuo Aida, Shizuoka (JP); Akinori Keira, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 113 days.

(21) Appl. No.: 11/806,176

(22) Filed: May 30, 2007

(65) Prior Publication Data

US 2007/0277372 A1 Dec. 6, 2007

(30) Foreign Application Priority Data

May 30, 2006 (JP) ..... 2006-149398

(51) Int. Cl.
*H01R 13/72* (2006.01)

(52) U.S. Cl. ..... 439/501

(58) Field of Classification Search ..... 439/501–505, 439/701; 29/754, 755, 854; 174/72 A; 248/693; 700/83, 97; 345/419, 420
See application file for complete search history.

(56) References Cited

U.S. PATENT DOCUMENTS 4,711,025 A * 12/1987 DeSanto ..... 29/854
4,951,385 A * 8/1990 DeSanto ..... 29/754
6,272,387 B1 * 8/2001 Yoon ..... 700/83
6,842,173 B2 * 1/2005 Sakakura et al. ..... 345/419
6,898,473 B2 * 5/2005 Kabasawa ..... 700/97
7,164,957 B2 * 1/2007 Tsuchiya et al. ..... 700/97
2003/0100228 A1 * 5/2003 Bungo et al. ..... 439/701
2006/0199427 A1 * 9/2006 Chan ..... 439/505
2007/0141899 A1 * 6/2007 Saini et al. ..... 439/502
2007/0184686 A1 * 8/2007 Hayashi et al. ..... 439/76.2
2008/0054154 A1 * 3/2008 Lin ..... 248/693

FOREIGN PATENT DOCUMENTS

JP 2004-111128 4/2004

* cited by examiner

*Primary Examiner*—Chandrika Prasad
(74) *Attorney, Agent, or Firm*—Kratz, Quintos & Hanson, LLP

(57) ABSTRACT

The present invention is to provide a wire harness assembly assist device, a wire harness assembly assist unit, and a method of assisting assembly of a wire harness with a reduced time for acquiring a necessary information and a reduced operation error. The assembly assist device for assisting assembly of a wire harness on a wiring board includes: a layout information acquiring program to display a layout screen showing a wiring layout of the wire harness; a component information acquiring program corresponding to a component to be attached; an attachment position information acquiring program to indicate an attachment position of the component; a guide screen information generating program to display the acquired component information superposed on the acquired attachment position of the layout screen based on the acquired layout information and the acquired attachment position information; and a display control program to display the generated guide screen information.

9 Claims, 12 Drawing Sheets

1···WIRE HARNESS ASSEMBLY ASSIST SYSTEM

WIRE HARNESS ASSEMBLY ASSIST PROGRAM

BACKGROUND OF THE INVENTION

1. Field of the Invention

The present invention relates to a wire harness assembly assist device, a wire harness assembly assist unit, and a method of assisting assembly of a wire harness by attaching a component of the wire harness to a wiring board.

2. Description of Related Art

Various types of electronic units are mounted in a motor vehicle as a vehicle. The motor vehicle includes wire harnesses to provide electric power from a power source and control signals from a computer to the electronic units. The wire harnesses include a plurality of sub-harnesses. The sub-harnesses are provided each for a system control of the motor vehicle. The sub-harnesses each include a plurality of electrical wires and connectors attached to ends of the electrical wires.

The electrical wires each have a conductive core wire and a cover made of an insulating synthetic resin. The electrical wires are so-called covered wires. Each connector has terminals and a connector housing to receive the terminals. The terminals made of a conductive metal sheet are connected to ends of the core wires of the electrical wires. The connector housing is made of a synthetic resin and has a box shape. The electronic units are connected to the terminals in the connector housing through the electrical wires in order to provide the electrical powers and signals.

In order to assemble the wire harness, the sub-harness is first formed with such a way that the electrical wire is cut to a prescribed length with a cutter and the connector is attached to the core wire exposed from the electrical wire and the connector is inserted into the connector housing. The sub-harnesses are then assembled together and attached with a grommet and protector in place to assemble the wire harness.

A wiring board is utilized for assisting assembly of the wire harness. FIG. 12 shows a conventional wiring apparatus for assembling a wire harness (JP-2004-111128,A).

The wiring apparatus 141 includes a rectangular shaped base plate 142, a plurality of wiring jigs 143 upstanding from the base plate 142, a shelf 144 disposed adjacent to the base plate 142, and component cases 145 disposed on the shelf 144. The base plate 142 and the wiring jigs 143 form a wiring board 146. JP-H09-147641,A discloses an assembly guide apparatus for assisting assembly of the wire harness but omits the apparatus in FIG. 7.

The wiring board 146 is sloped and supported with legs 147. The slope provides a worker with an easy and effective wiring at the wiring board 146 having a deep depth. Otherwise, the worker can not reach a back area of the wiring board 146.

Wiring is performed with arrangement of each electrical wire 148 along the respective wiring jigs 143. Components such as a protector tube 149 or protector are attached to the wired electrical wires 148. The ends of the electrical wires 148 are connected with terminals (not shown). The connectors are then inserted into a connector housing to form a connector 150. A plurality of the electrical wires 148 are bundled with a vinyl tape to form the wire harness.

In the conventional wiring apparatus, the components are arranged by confirming the positions with drawings of jigs or product or by confirming the wiring path with drawings of the product or sub-drawings every circuitry. It takes time to find out the desired information. The increase of the number of the circuitries makes the confirmation of the position of the components and the arrangement of the electrical wires difficult, and increases the time of the confirmation. The worker confirms the drawings of the jigs and the product with eyes, so that it is difficult to prevent a pick-up error and a working error.

SUMMARY OF THE INVENTION

The present invention is to provide a wire harness assembly assist device, a wire harness assembly assist unit, and a method of assisting assembly of a wire harness for quickly acquiring a desired information and reducing a false assembling.

According to a first aspect of the present invention, a wire harness assembly assist device for assisting assembly of a wire harness with a component attached on a wiring board, the device includes: a layout information acquiring program for acquiring a layout information displaying a layout screen showing a wiring layout of the wire harness to be assembled on the wiring board; a component information acquiring program for acquiring a component information corresponding to a component to be attached on the wiring board; an attachment position information acquiring program for acquiring an attachment position information indicating an attachment position of the component on the wiring board; a guide screen information generating program for generating a guide screen information, the guide screen information displaying the acquired component information superposed on the acquired attachment position of the layout screen based on the acquired layout information and the acquired attachment position information; and a display control program for controlling display of the generated guide screen information.

Preferably, the guide screen information generating program generates the guide screen information displaying a label corresponding to the component information superposed on the attachment position of the layout screen.

Preferably, the wire harness assembly assist device further includes an attached component detection program for detecting the component attached on the wiring board, the guide screen information generating program generating the guide screen information displaying the component information superposed on the layout screen so that a visible distinction between the attached component and the component to be attached is possible.

Preferably, the wire harness assembly assist device further includes an assembly screen information generating program for generating an assembly screen information displaying an attachment position of a mating component to be assembled with the component, the display control program controlling display of the generated assembly screen information.

Preferably, the wire harness assembly assist device further includes a guide information acquiring program for acquiring a guide information to guide insertion of an electrical wire with a terminal to a hole of an associated connector when the component includes the electrical wire and the connector, the assembly screen information generating program generating the assembly screen information displaying an electrical wire information of the electrical wire with the terminal superposed on the position of the insertion hole of the connector of an insertion hole position screen.

Preferably, the wire harness assembly assist device further includes an insertion detection program for detecting insertion of the electrical wire with the terminal into the insertion hole of the connector, the guide screen information generating program generating the assembly screen information displaying the electrical information superposed on the insertion hole position screen so that a visible distinction between the detected inserted electrical wire and the electrical wire to be inserted is possible.

Preferably, the wire harness assembly assist device further includes a shortage information input program for inputting a shortage information indicating a position of shortage of the component on the layout screen, and a shortage information memory program for storing the inputted shortage information.

According to a second aspect of the present invention, a wire harness assembly assist unit includes the wire harness assembly assist device and a display device for displaying the guide screen information in response to control of the display control program of the wire harness assembly assist device.

According to a third aspect of the present invention, a method of assisting assembly of a wire harness with a component on a wiring board, the method includes the steps of: acquiring a layout information of the wire harness to be wired on the wiring board; acquiring a component information corresponding to the component to be attached on the wiring board; acquiring an attachment position information displaying an attachment position of the component on the wiring board; generating a guide screen information displaying the acquired component information superposed on the acquired attachment position of the layout screen based on the acquired layout information and the acquired attachment position information; and displaying the generated guide screen information.

DETAILED DESCRIPTION OF THE PREFERRED EMBODIMENTS

FIGS. 2-5 explain an embodiment of a wire harness assembly assist system according to the present invention. The assembly assist system assists assembly of a wire harness by attaching a connector to an electrical wire on a wiring board.

Figure 2:
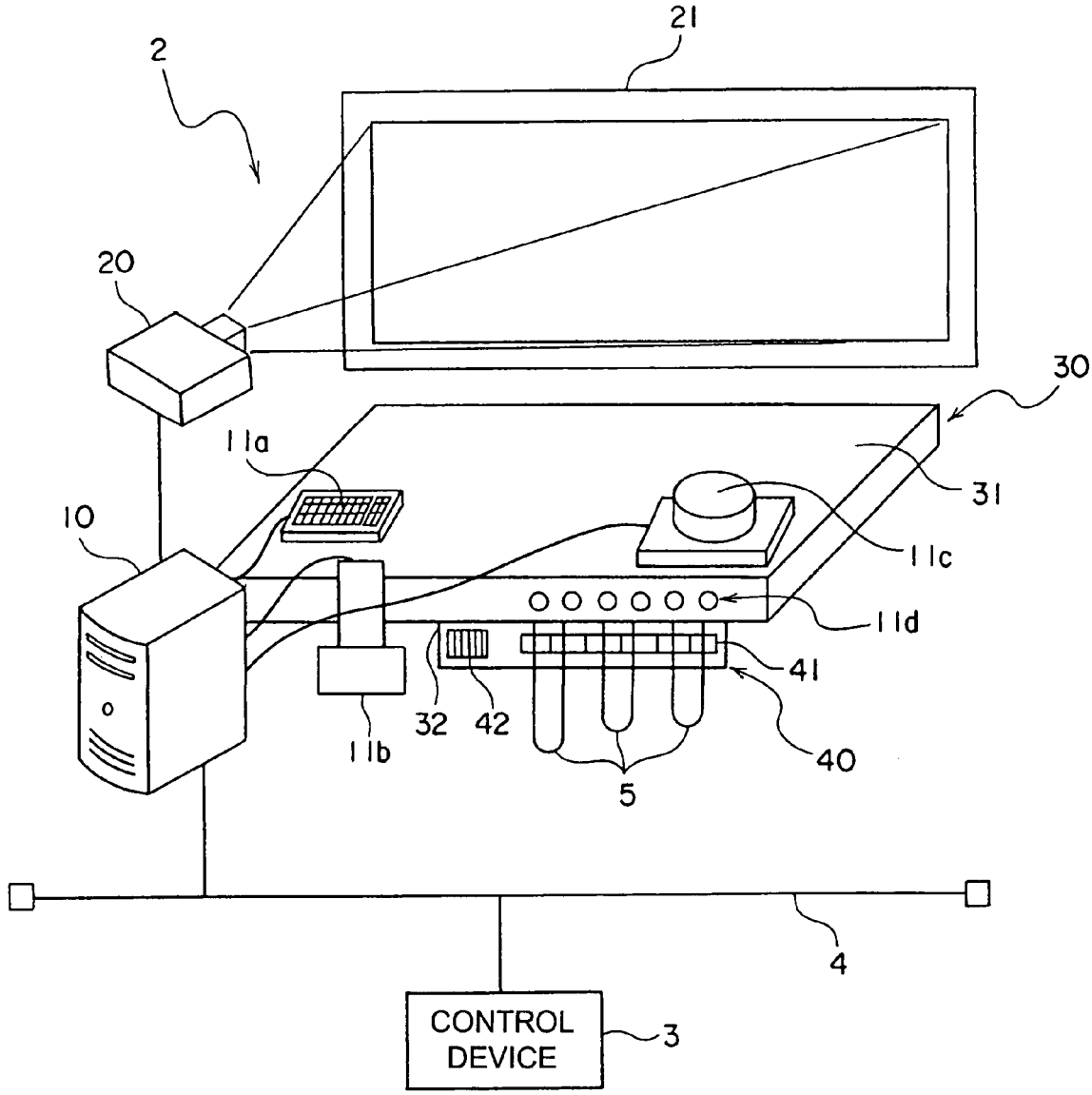
FIG. 2 is a configuration of the wire harness assembly assist system of the present invention.
Figure 3:
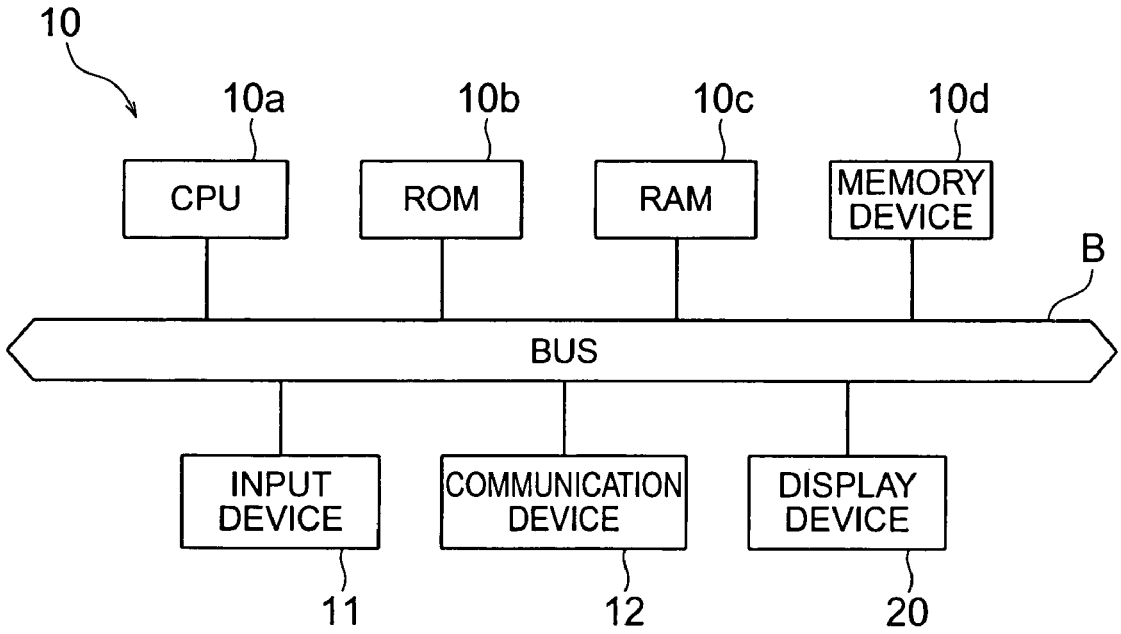
FIG. 3 is a schematic configuration of devices linked to the wire harness assembly assist device.

Referring to FIG. 2, the wire harness assembly assist system 1, hereafter referred to assembly assist system, includes a wire harness assembly assist unit 2, hereafter referred to assembly assist unit, and a control device (file server) 3. The assembly assist unit 2 is linked to the control device 3 via a communication line 4 for exchange of information.

The assembly assist unit 2 is installed on a productive facility or a production line and includes a wire harness assembly assist device 10, hereafter referred to assembly assist device, a display device 20, and the wiring board 30. The assembly assist device 10 assists assembly of the wire harness by attaching components on the wiring board 30. The electrical wires and components are arranged in place on the wiring board 30.

The wire harness includes a plurality of sub-harnesses. The sub-harnesses have the plurality of the electrical wires and connectors attached to ends of the electrical wires and are arranged in accordance with control systems of a motor vehicle.

The assembly assist device 10 is a computer and includes a central processing unit (CPU) 10*a* to control an operation of the assembly assist unit 2 in accordance with a prescribed program. The CPU 10*a* is linked to a ROM 10*b* and a RAM 10*c* via a bus B. The ROM 10*b* stores the program of the CPU 10*a* and the RAM 10*c* provides a working area of the CPU 10*a*.

Figure 4:
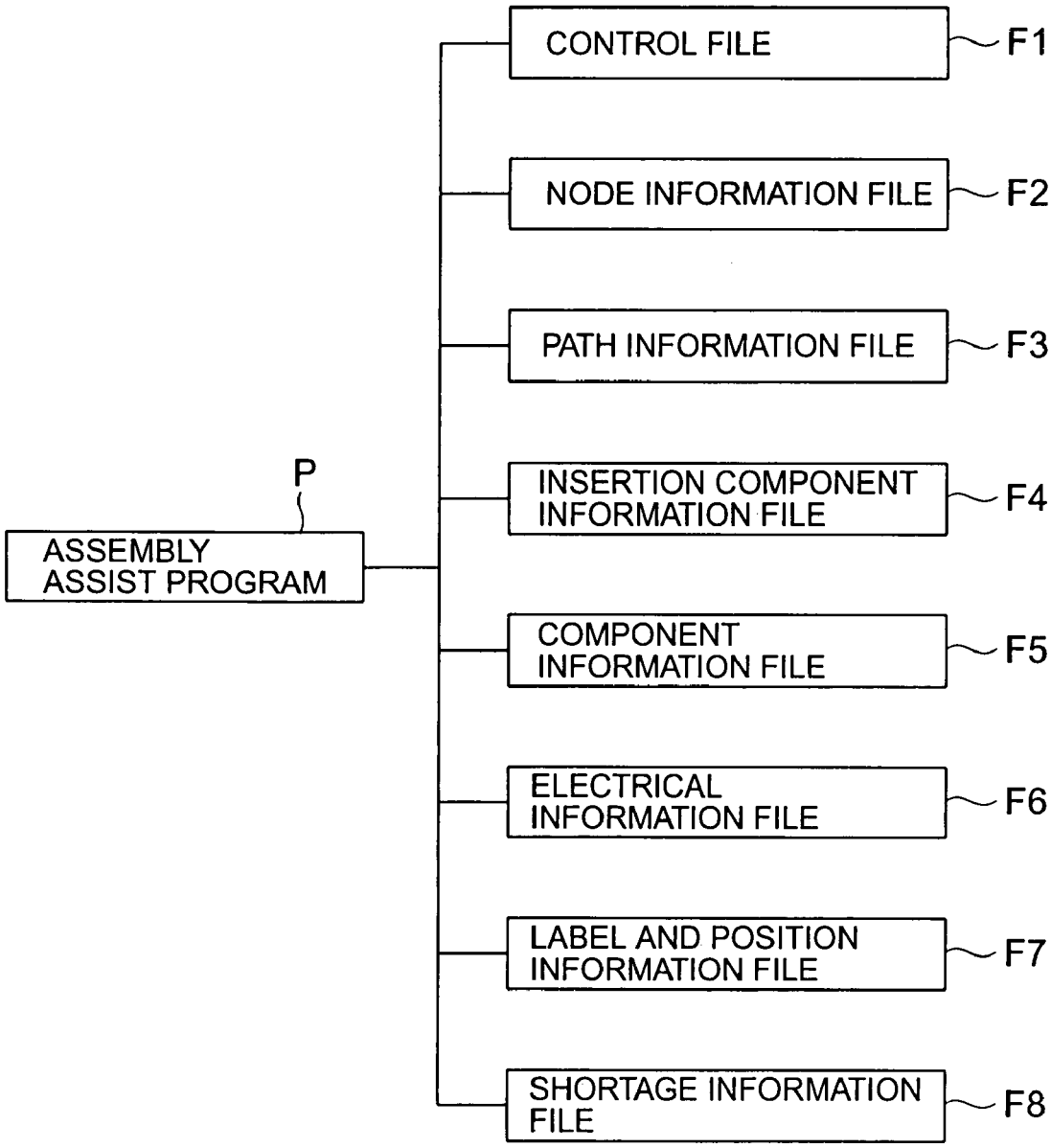
FIG. 4 illustrates a relation between an assembly assist program and a plurality of files of the wire harness assembly assist system.

The CPU 10*a* is linked to a memory device 10*d* such as a hard disk via the bus B. The memory device 10*d* stores various programs such as an assembly assist program P for the assembly assist device 10 and various files such as a control file F1 as shown in FIG. 4.

The CPU 10*a* is linked to an input device 11, a communication device 12, and the display device 20 via the bus B. The input device 11 includes a keyboard 11*a*, a scanner 11*b*, a guide button 11*c*, and an LED array 11*d*, which are linked to the bus B via interfaces (not shown).

A data inputted with the keyboard 11*a* is directed to the CPU 10*a*. The scanner 11*b* reads a barcode and inputs the read date to the CPU 10*a*. A data inputted with the guide button 11*c* is directed to the CPU 10*a*.

The LED array 11*d* has a plurality of LEDs (six LEDs in FIG. 2) corresponding to a plurality of clamps 41 disposed on a rod 40. The CPU 10*a* controls lighting of the LED array 11*d*. The LED array 11*d* is a type of push-button switch. When the switches are pushed, the associated data are inputted to the CPU 10*a*.

The rod 40 holds the clamps 41, which are disposed parallel to each other, with a rail-shaped holder. The electrical wires 5 are tentatively held with the clamps 41 and the rod 40 is attached to the wiring board 30 so that the LED array 11*d* of the wiring board 30 corresponds to the clamps 41. A worker assembles the electrical wires 5 held with the clamps 41 to jigs on the wiring board 30. The rod 40 has a bar code 42 to indicate an identification code thereof.

The communication device 12 utilizes, for example, a LAN card and a portable phone modem. The communication device 12 outputs the information, which is received from the control device 3 via the communication line 4, to the CPU 10*a*, and transmits the information received from the CPU 10*a* to designated devices.

The display device 20 is a projector and projects several informations on a screen 21 disposed in front of the wiring board 30 and having a size nearly same as the wiring board 30. The present invention utilizes the projector but the display device 20 is not limited thereto and LCD display device, a CRT, or the like is also utilized.

The wiring board 30 includes a rectangular wide base plate 31, a rod mounting portion 32 to be attached with the rod 40, and a plurality of wiring jigs (not shown) upstanding from the base plate 30. The LED array 11*d* is disposed on the wiring board 30 in the vicinity of the rod mounting portion 32. The assembly assist device 10 controls to light on the LED array 11*d* corresponding to the pertinent electrical wires 5 so that the worker can assuredly remove the electrical wires 5 from the rod 40 and reduce working mistake.

The control device 3 includes a computer similarly to the assembly assist device 10 and controls a plurality of files related to the present invention. The control device 3 transfers the files to the assembly assist device 10 upon request by the assembly assist device 10. The control device 3 functions as a file server and controls the information about an order of the assembly of the wire harness.

Referring to FIG. 4, an example of the files according to the assembly assist system 1 of the present invention is depicted. A configuration of the files is optionally changed in response to that of the system 1.

The assembly assist system 1 includes the assembly assist program P, the control file F1, a node information file F2, a path information file F3, an insertion component information file F4, a component information file F5, an electrical wire information file F6, a label and position information file F7, and a shortage information file F8.

Figure 1:
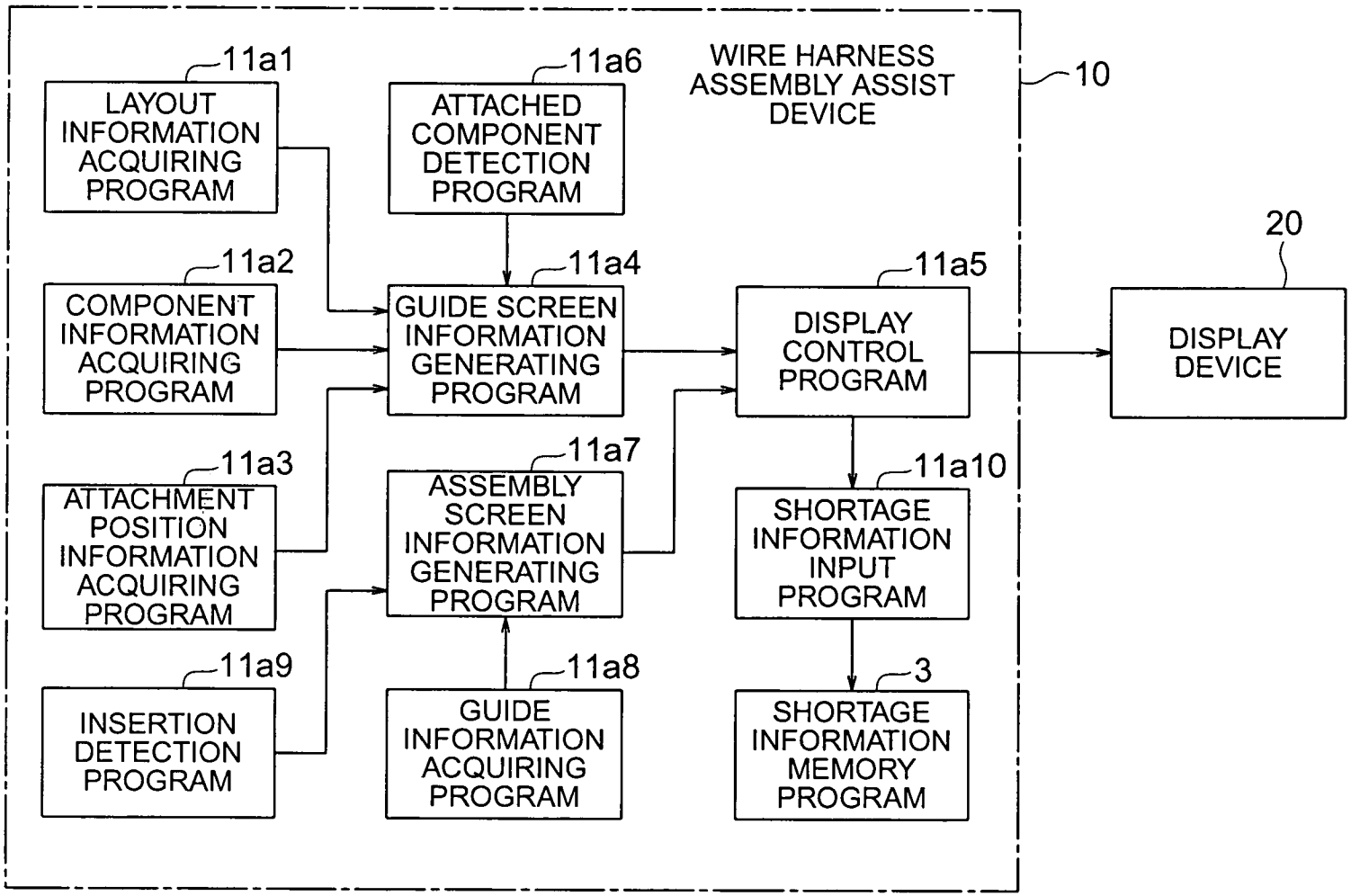
FIG. 1 is a block diagram of a wire harness assembly assist device and a display device of a wire harness assembly assist system of the present invention.

The assembly assist program P is stored in the memory device 10*d* of the assembly assist device 10. Referring to FIG. 1, the assembly assist program P of the assembly assist device 10 includes a layout information acquiring program 11*a*1, a component information acquiring program 11*a*2, an attachment position information acquiring program 11*a*3, a guide screen information generating program 11*a*4, a display control program 11*a*5, an attached component detection program 11*a*6, an assembly screen information generating program 11*a*7, a guide information acquiring program 11*a*8, an insertion detection program 11*a*9, and a shortage information input program 11*a*10. Those programs are executed by the CPU 10*a*. The assembly assist program P refers the control file F1, the node information file F2, the path information file F3, the insertion component information file F4, the component information file F5, the electrical wire information file F6, and the label and position information file F7, and refers and changes the shortage information file F8. The files F1-F7 are stored in a memory device which is accessible with the control device 3.

The control file F1 includes a wire harness part number, a size of the wiring board, and file names of the node information, the path information, the insertion component information, the component information, the electrical information. The control file F1 associates the respective clamps 41 of the rod 40 with the respective file names to assemble the wire harness with the respective clamps 41. The assembly assist program P refers to the control file F1 to acquire several informations from the control device 3. The control file F1 is accessible with the file name or the path name.

The node information file F2 has data of nodes of the wire harness arranged on the wiring board 30. The data are, for example, end portions of the wire harnesses and joint portions of the electrical wires.

The path information file F3 includes data related to paths between the nodes indicated by the node information file F2.

The node information file F2 and the path information file F3 form a wiring layout, or a layout information, on the wiring board 3.

The insertion component information file F4 includes data related to the insertion components and insertion positions thereof to the connectors.

The component information file F5 includes data related to the components such as tapes, tubes, protectors, and clips.

The electrical wire information file F6 includes data of part numbers, colors, lengths of the electrical wires.

The label and position information file F7 includes data of labels of the electrical wires and the components, and data of positions displaying the labels on the screen.

Figure 5:
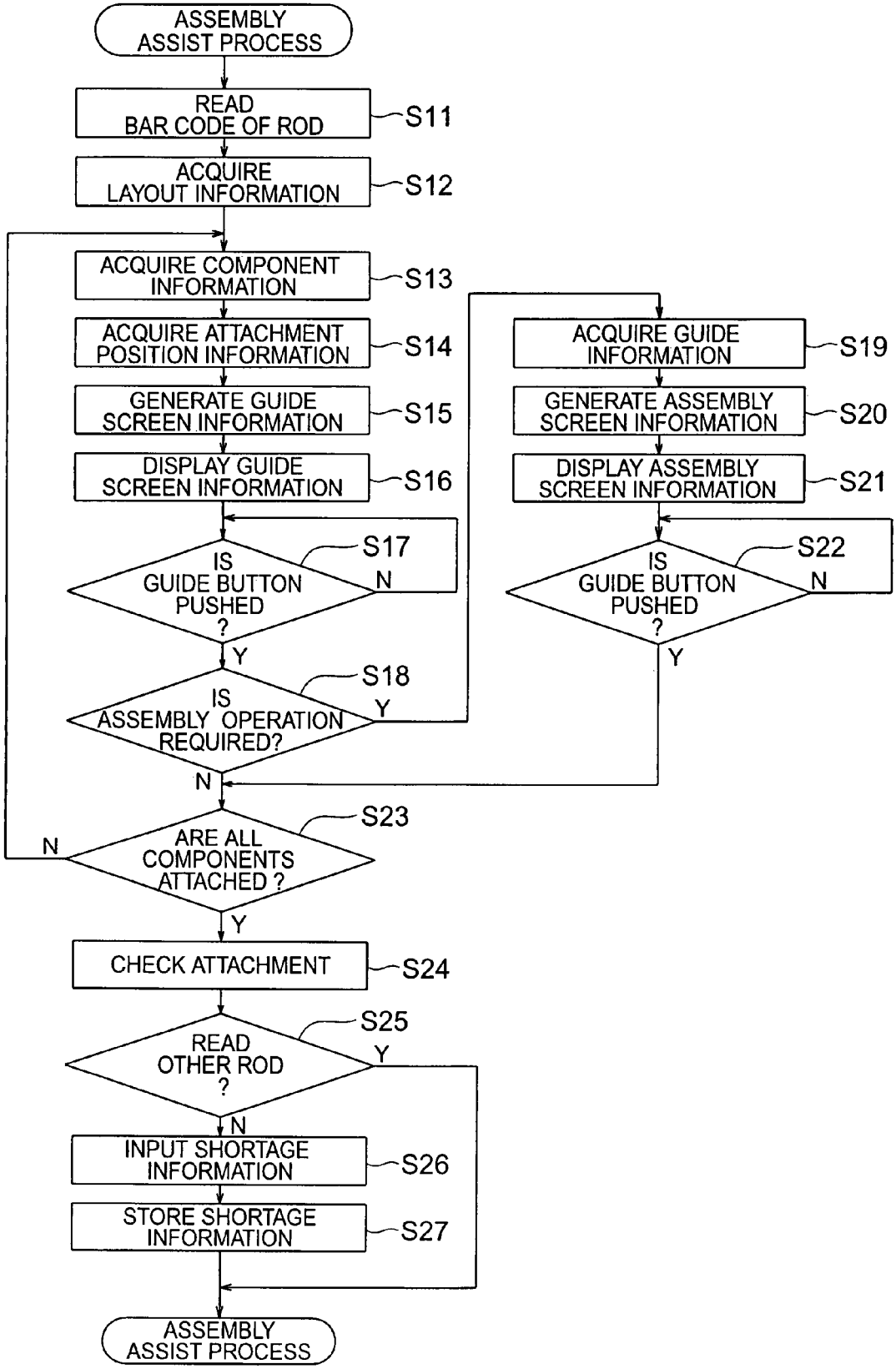
FIG. 5 is a flowchart processed with a CPU of FIG. 3 for assisting assembly of a wire harness.

FIG. 5 shows a flowchart processed with the CPU 10*a* of the assembly assist device 10.

At step S11, the bar code 42 of the rod 40 indicating the part number of the wire harness is scanned with the scanner 11*b* or the bar code 42 is inputted from the key board 11*a* and the inputted data are stored into the RAM 10*c*. The CPU 10*a* requests the control device 3 via the communication device 12 to transmit the control file F1 relevant to the part number of the wire harness, and stores the received control file F1 in the memory device 10*d*.

At step S12 (layout information acquiring program), the CPU 10*a* requests the control device 3 via the communication device 12 to transmit the node information and the path information based on the part number of the wire harness in the RAM 10*c* and the control file F1 in the memory device 10*d*, and stores the received data in the memory device 10*d* as the layout information.

At step S13 (component information acquiring program), the CPU 10*a* requests the control device 3 via the communication device 12 to transmit the component information and the electrical wire information based on the part number of the wire harness in the RAM 10*c* and the control file F1 in the memory device 10*d*, and stores the received data in the memory device 10*d* as the component information.

At step S14 (attachment position information acquiring program), the CPU 10*a* requests the control device 3 via the communication device 12 to transmit the label and position information based on the part number of the wire harness in the RAM 10*c* and the control file F1 in the memory device 10*d*, and stores the received data in the memory device 10*d* as the attachment position information.

At step S15 (guide screen information generating program), a guide screen information is generated in the RAM 10*c* based on the acquired layout information and the acquired attachment position information. The generated guide screen information appears that the acquired component information is superposed on the acquired attachment position on the layout screen.

At step S16 (display control program), the CPU 10*a* controls the display device 20 to display the guide screen information stored in the RAM 10*c*. The display device 20 thus displays the guide screen information on the screen 21 in front of the wiring board 30.

At step S17 (attached component detection program), a judgment is made whether or not the guide button 11*c* is pushed. The guide button 11*c* is pushed by the worker upon completion of the assembly corresponding to the displayed guide screen information. Step S17 functions as the attached component detection program to detect the attached component on the wiring board 30. The attached component detection program can be replaced with electrical switches.

When the guide button 11*c* is not pushed (N at S17), the assembly assist process is repeated until the guide button 11*c* is pushed. When the guide button 11*c* is pushed (Y at S17), the process moves to step S18.

At step S18, a judgment is made whether or not the assembly assist process is required based on the setting of the insertion component information file in the control file F1 of the memory device 10*d*. When the insertion component information file name is not set (Nat S18), the CPU 10*a* judges that the assembly assist operation is not required and the process goes to step S23. When the insertion component information file name is set (Y at S18), the CPU 10*a* judges that the assembly assist operation is required and the process goes to step S19.

At step S19 (guide information acquiring program), the CPU 10*a* requests the control device 3 via the communication device 12 to transmit the insertion component information based on the part number of the wire harness in the RAM 10*c* and the control file F1 in the memory device 10*d*, and stores the received data in the memory device 10*d* as the guide information.

At step S20 (assembly screen information generating program), an assembly screen information is generated in the RAM 10*c* based on the acquired guide information. The assembly screen information displays the attachment position of the connectors to be connected with the terminals of the electrical wires 5.

At step S21 (display control program), the CPU 10*a* requests the display device 20 to display the assembly screen information and the process goes to step S22. The display device 20 displays the received assembly screen information on the screen 21 in front of the wiring board 30.

At step S22 (insertion detection program), a judgment is made whether or not the guide button 11*c* is pushed. The guide button 11*c* is pushed by the worker when the assembly is completed with respect to the assembly screen information. Step S22 functions as the insertion detection program to detect the insertion of the electrical wires with the terminals to the holes of the connectors. The insertion detection program can be replaced with the electrical switches.

When the guide button 11*c* is not pushed (N at step S22), it is judged the process not completed and the process is repeated until the guide button 11*c* is pushed. When the guide button 11*c* is pushed (Y at step S22), the process moves to step S23.

At step S23, a judgment is made whether or not all components are completely attached. When the attachment is not completed (N at step S23), the process returns to step S13 and is repeated. When the process is completed (Y at step S23), the process moves to step S24.

At step S24, the attachment of the components is certified and the certified result is stored in the memory device 10*d* in time-line as an attachment result information (record) and the process moves to step S25.

At step S25, a selection screen information is displayed with the display device 20 so that the worker selects to read or not to read the bar code 42 of the other rod 40. Upon the selection of the screen, a judgment is made whether or not the bar code of the other rod is read. When the reading is required (Y at step S25), the process returns to step S11 and is repeated a series of the steps. When the reading is not required (N at step S25), the process moves to step S26.

At step S26 (shortage information input program), the shortage input screen information is displayed on the layout screen with the display device 20 to indicate the positions of shortage of the components. The worker inputs the shortage information in the shortage input screen information.

At step S27 (shortage information memory program), the shortage information is transmitted to the control device 3 and stored in the shortage information file F8 and the process returns to S11 and the series of the steps are repeated. The shortage information can be inputted at step S16 or step s21.

An example of operation of the assembly assist unit 2 of the assembly assist system 1 is explained.

Figure 6:
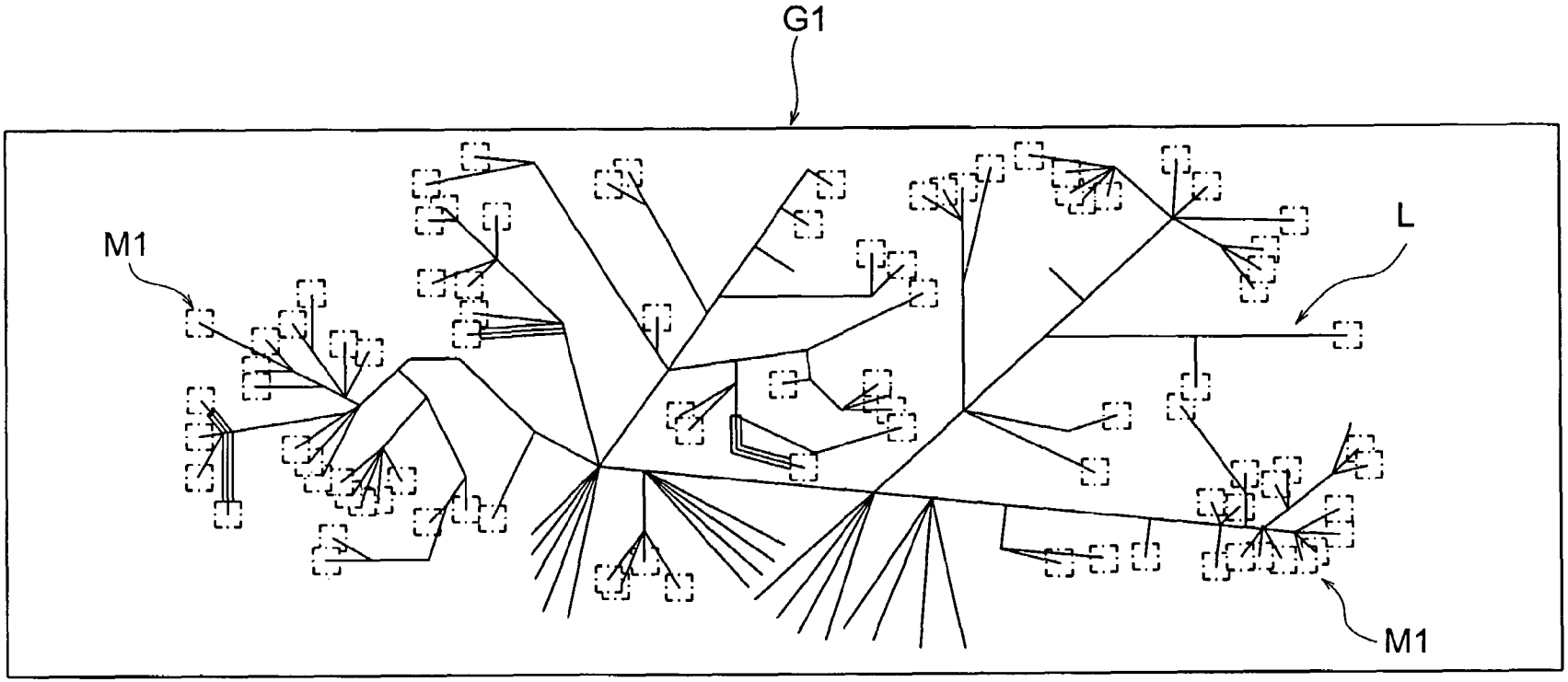
FIG. 6 is a layout screen.

The electrical wires 5 are temporarily held with the clamps 41 of the rod 40 and the rod 40 is attached to the rod mounting portion 32 of the wiring board 30. The bar code 42 of the rod 40 read with the scanner 11*b* or inputted by with the keyboard 11*a* is inputted to the assembly assist device 10. The assembly assist device 10 acquires the layout information and working order information corresponding to the wire harness to be assembled from the control device 3. FIG. 6 is a layout screen G1 displayed on the screen 21 and showing the layout information of the wire harnesses indicated by solid lines L and positions of connectors to be attached indicated marks M1.

The assembly assist device 10 acquires the component information and the attachment position information of the connectors to be attached on the wiring board 30 according to the sequence of operation. The assembly assist device 10 controls the display device 20 to display a guide screen information G2 on the screen 21 based on the layout information and the attachment position information. The guide screen information G2 appears that the acquired component information is superposed on the attachment position of the layout screen G1.

Figure 7:
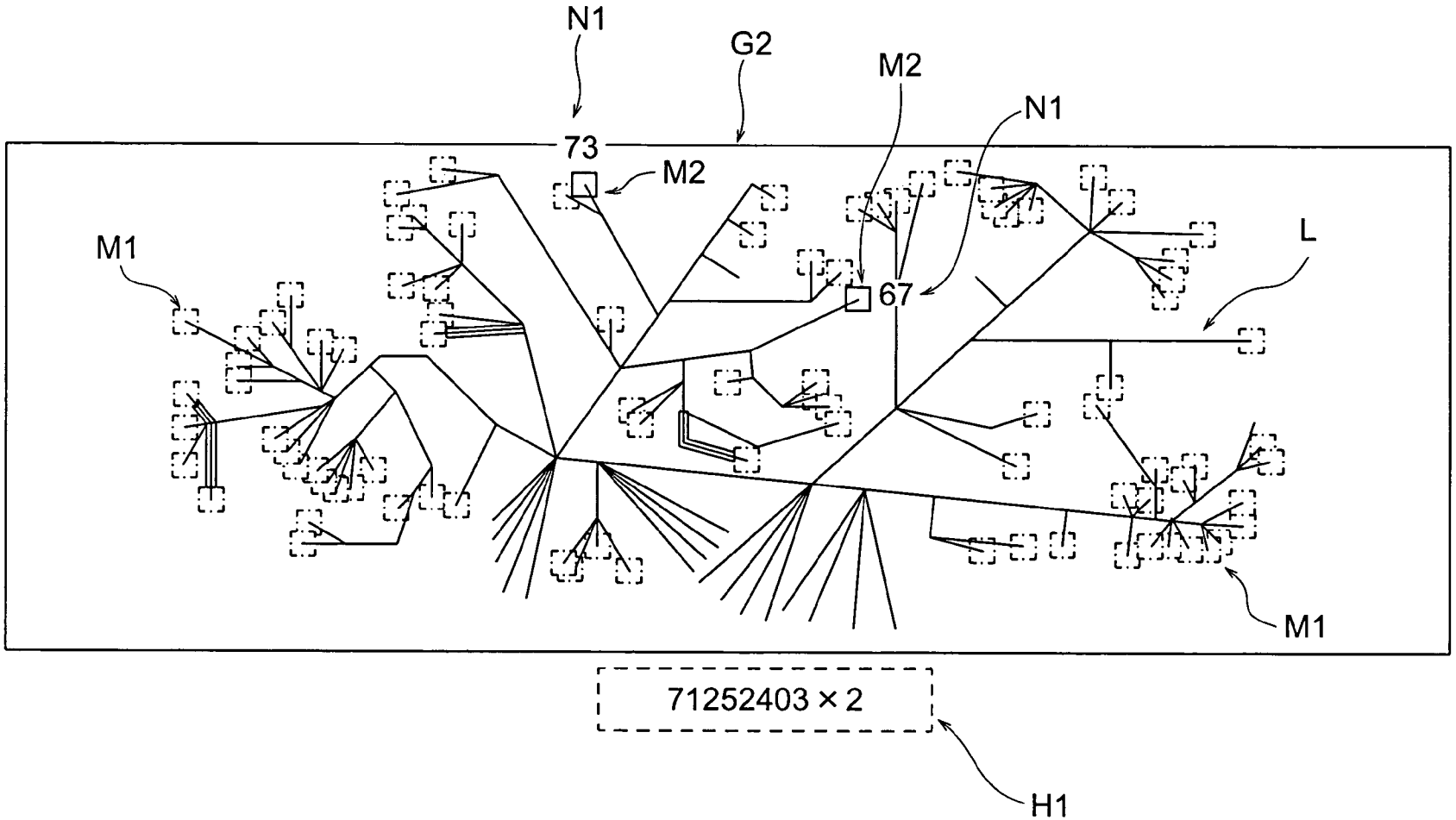
FIG. 7 is a guide screen information.

The guide screen information G2 of FIG. 7 shows that two marks M2 are superposed on the attachment positions of the respective connectors. The guide screen information G2 displays the attaching positions of the connectors and the status (attached or not attached yet) of the connectors. End numbers of the wire harnesses are displayed near the guide marks M2. Addresses assigned on the wiring board 30 can be displayed close to the marks M2. The guide screen information G2 displays a part number and a number of the connectors at a part display area H1 positioned at a lower portion of the screen 21.

Figure 8:
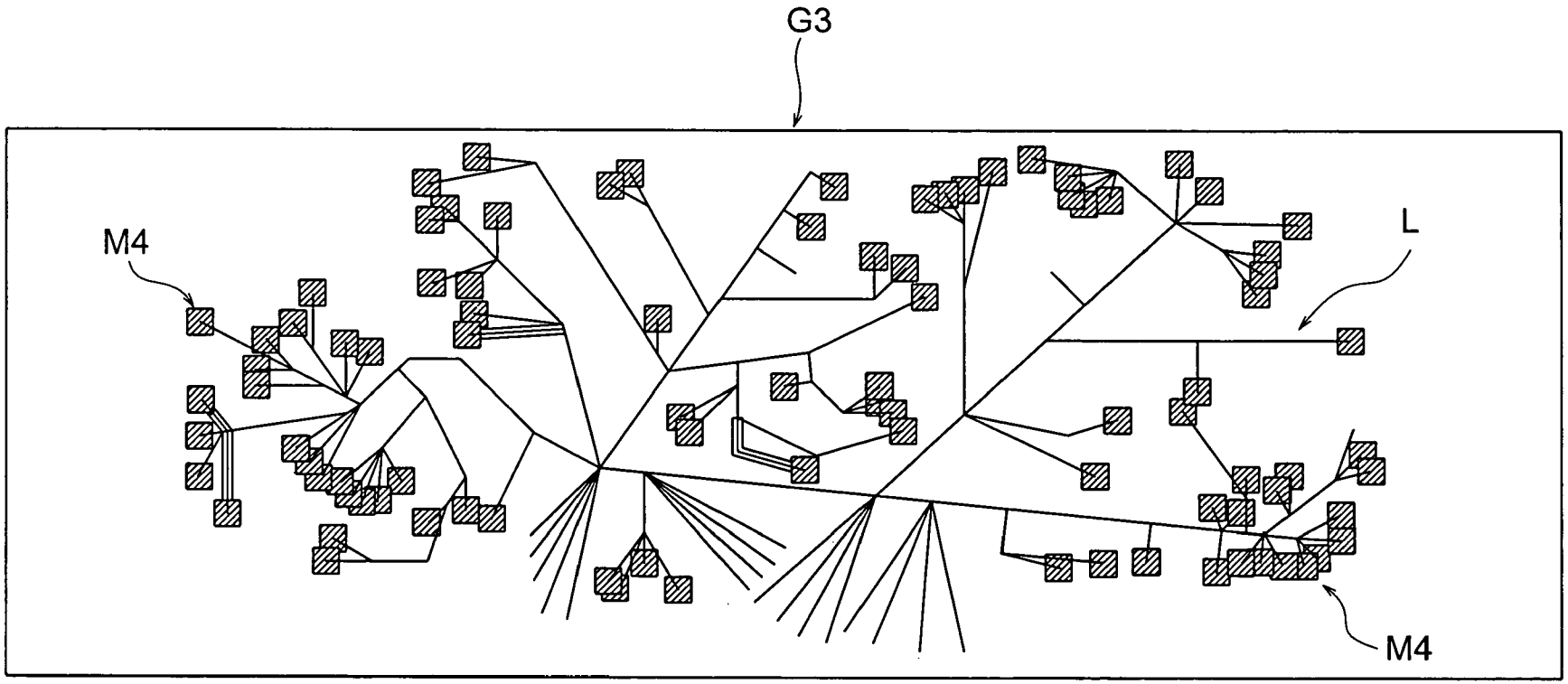
FIG. 8 is a guide screen information.

When the worker pushes the guide button 11*c*, the assembly assist device 10 judges that the attachment of the connectors is finished, and controls the display device 20 to change the display from the guide screen information G2 to a guide screen information G3 of FIG. 8 on the screen 21. In the guide screen information G3, all positions corresponding to the connectors are indicated with marks M4.

Figure 9:
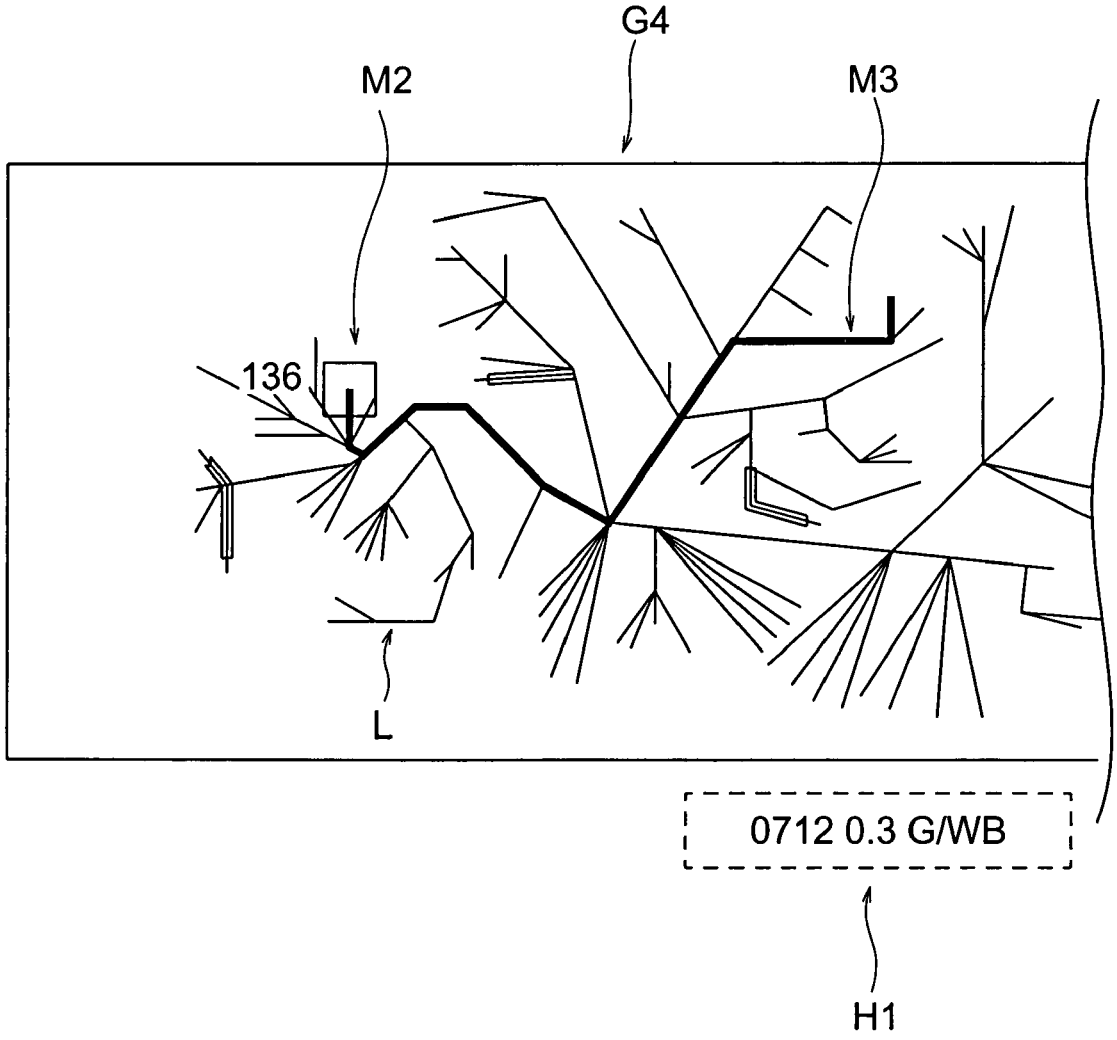
FIG. 9 is a guide screen information.

The assembly assist device 10 lights the LED array 11*d* corresponding to the clamps 41 temporarily holding the electrical wires 5 and acquires the component information and attachment position information of the electrical wires to be attached on the wiring board 30. The assembly assist device 10 generates a guide screen information G4 based on the layout information and the attachment position information, and controls the display device 20 to display the guide screen information G4 on the screen 21 as shown in FIG. 9. The guide screen information G4 appears that the acquired component information is superposed on the attachment position on the layout screen G1.

The guide screen information G4 displays the attachment position of the electrical wire indicated by a heavy line M3 and the connector to be connected with the electrical wire indicated by the mark M2. The component display area H1, or the lower area of the guide screen information G4 shows a number, a size, a color, and so on, of the guide electrical wire 5 so that the worker can arrange the electrical wire 5 by referring to the mark M3 on the screen 21.

The assembly assist device 10 acquires the associated guide information for wiring the electrical wires 5 and generates an assembly screen information G5 indicating the attachment positions of the connectors to be connected to the electrical wires 5, and controls the display device 20 to display the assembly screen information G5 on the screen 21.

Figure 10:
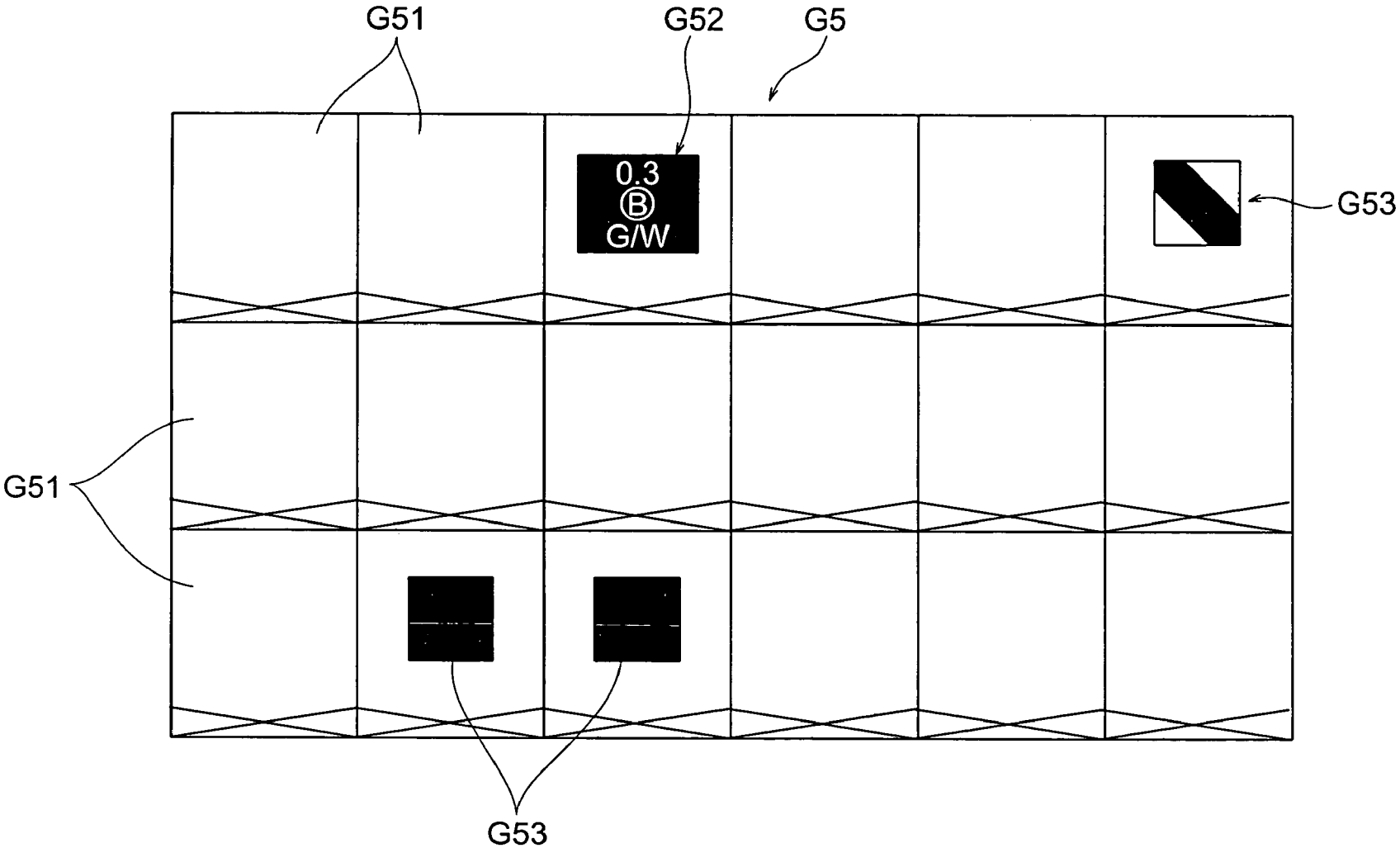
FIG. 10 is an assembly screen information showing a schematic front view of a connector with a plurality of insertion holes.

Referring to FIG. 10, the assembly screen information G5 is a view of an insertion hole position screen. The assembly screen information G5 includes a plurality of connector insertion holes G51, an electrical wire mark G52 indicating the component identification, and inserted electrical wire marks G53. The inserted electrical wire marks G53 prevent the false insertion of the electrical wire 5 with the worker.

Figure 11:
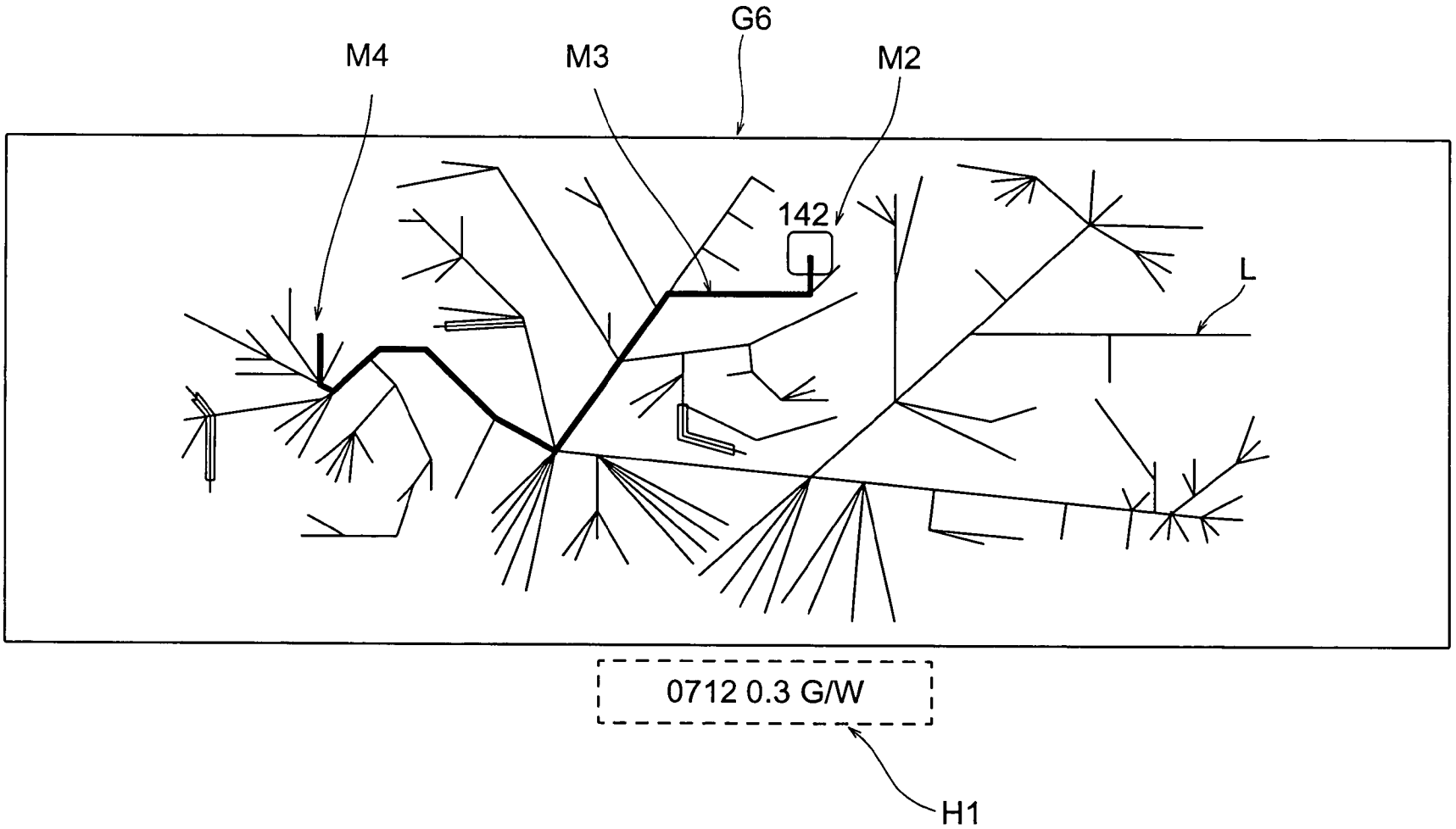
FIG. 11 is a guide screen information.
Figure 12:
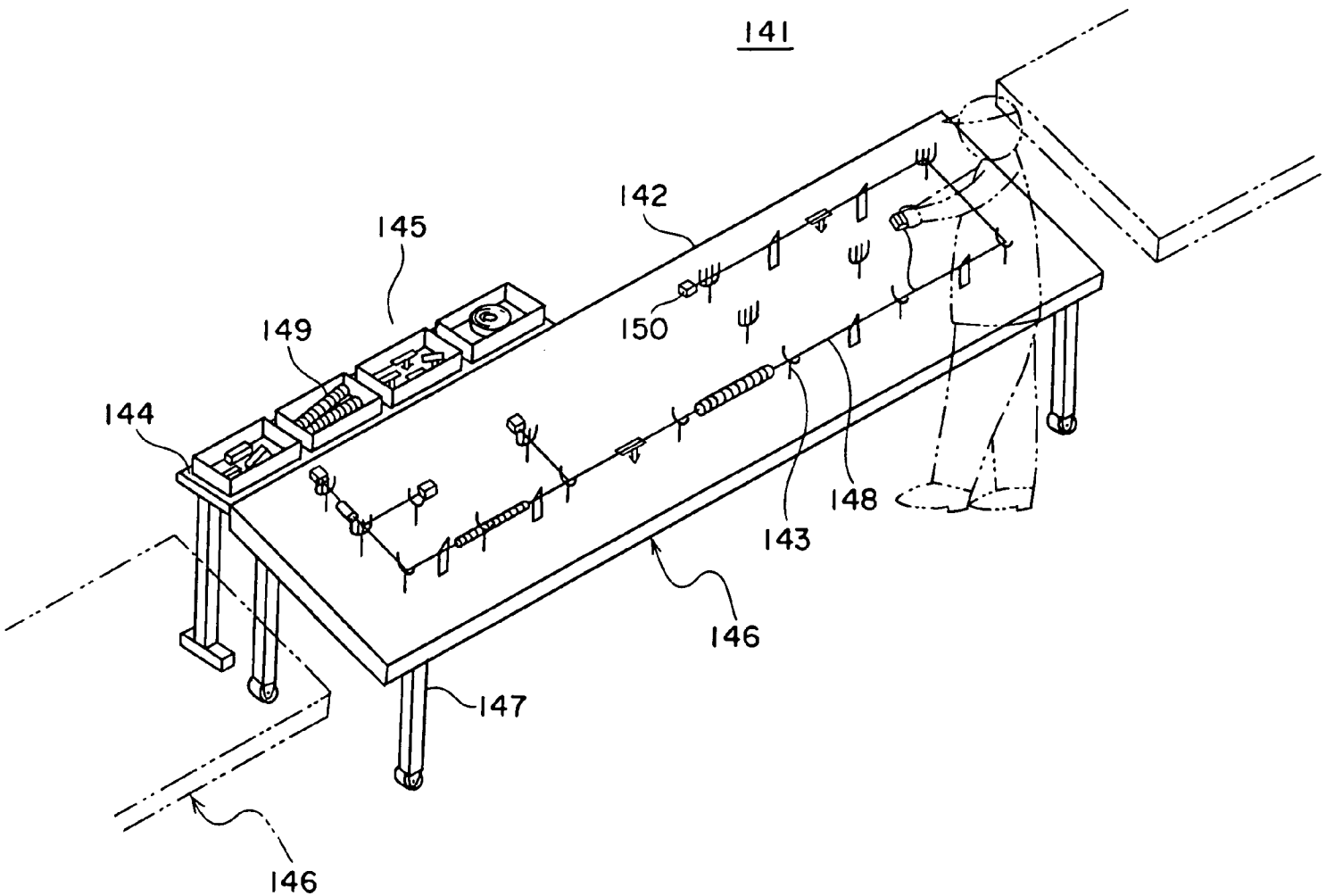
FIG. 12 PRIOR ART
FIG. 12 shows a conventional wiring apparatus utilizing conventional wiring jigs.

When the worker pushes the guide button 11*c*, the assembly assist device 10 judges the insertion of the electrical wires into the connectors finished, and controls the display device 20 to change the screen 21 from the guide screen information G5 to a guide screen information G6 of FIG. 11. The guide screen information G6 displays the mark M4 indicating the insertion of the electrical wire into the connector, and a mark M2 which is an opposite end of the mark M4. The marks M2 and M4 are superposed on the guide screen information G6. The worker can arrange the electrical wire 5 toward the mark M2 to connect with the other connector so that the worker can make a plurality of the assemblies by referring to the guide screen information G6.

The assembly assist device 10 of the assembly assist unit 2 generates and displays the guide screen information on the screen 21 with the display device 20. The worker can confirm the attachment positions of the components on the wiring board 30 so that the worker can easily find out the desired information and reduce the false attachment. It is preferable that the guide screen informations are displayed in the order of working.

The marks (labels) corresponding to the component information are superposed on the attachment positions in the layout screen G1 so that the worker can quickly confirm the attachment positions on the wiring board 30 from the marks.

The guide screen information provides a visible distinction between the attached component and the component to be attached. The worker can increase the work efficiency with reference to the guide screen information.

The assembly assist device acquires the guide information to guide the insertion holes of the connectors for connecting with the electrical wires with the terminals. The assembly screen information displays the electrical wire information indicating the electrical wires connected with the terminals superposed on the positions of the insertion holes of the connectors of the insertion hole position screen. The worker can insert the electrical wires with the terminals into the connectors while confirming the insertion positions and reduce the false insertion and increase the work efficiency.

The assembly screen information displays the electrical wire information on the insertion hole position screen of the connectors to make the visible distinction between the electrical wires connected or to be connected to the connectors. The worker can reduce the false insertion and increase the work efficiency.

The assembly assist unit 2 assembles the electrical wires 5 and the connectors. It is appreciated that the assembly assist unit 2 can assemble the plurality of the components such as the electrical wires 5, the connectors, tapes, and tubes.

The connection screen information G5 displays the connectors with a prescribed angle. It is appreciated that the assembly screen information G5 has a variety of display arrangements.

It is appreciated that the assembly screen information G5 schematically displays the attaching angles of the connectors corresponding to the prescribed angles of the connectors on the wiring board 30.

It is appreciated that the assembly screen information G5 displays the associated illustrations of the connectors in response to the direction of rotation angle and the angle thereof inputted from the input device 11 (direction key, mouse, and so on). The worker can thus arbitrarily rotate the assembly screen information G5 with the desired direction and angle.

The worker can easily identify the angles of the connectors by referring to the assembly screen information G5 and quickly and correctly identify the guide positions of the electrical wires. The work efficiency is further improved. The rotation function can also be adapted to the guide screen information.

It is appreciated that the guide screen information and the assembly screen information can display the electrical wires of the same path and terminals into a group.

It is appreciated that the mark M3 on the layout L of the guide screen information G4 (FIG. 9) indicates a single line but can indicate a plurality of the lines M3.

It is appreciated that the assembly screen information G5 displays the electrical wire marks G52 in the respective insertion holes G51.

The components held with the rod 40 are guided in order for assembling the wire harness. The present invention is not limited to the order.

It is appreciated that the assembly assist device 10 acquires the part numbers of the electrical wires, the connectors, and soon from the bar codes or tags attached thereto, and controls the display device 20 to display the guide screen information corresponding to the part numbers.

The embodiments are only exemplary but not limited thereto. Any modification and alteration are within the spirit and the scope of the present invention.

What is claimed is:

1. A wire harness assembly assist device for assisting assembly of a wire harness with a component attached on a wiring board, the device comprising:

a layout information acquiring program for acquiring a layout information displaying a layout screen showing a wiring layout of the wire harness to be assembled on the wiring board;

a component information acquiring program for acquiring a component information corresponding to a component to be attached on the wiring board;

an attachment position information acquiring program for acquiring an attachment position information indicating an attachment position of the component on the wiring board;

a guide screen information generating program for generating a guide screen information, the guide screen information displaying the acquired component information superposed on the acquired attachment position of the layout screen based on the acquired layout information and the acquired attachment position information; and a display control program for controlling display of the generated guide screen information.

2. The wire harness assembly assist device as claimed in claim 1, wherein the guide screen information generating program generates the guide screen information displaying a label corresponding to the component information superposed on the attachment position of the layout screen.

3. The wire harness assembly assist device as claimed in claim 1, further comprising an attached component detection program for detecting the component attached on the wiring board, the guide screen information generating program generating the guide screen information displaying the component information superposed on the layout screen so that a visible distinction between the attached component and the component to be attached is possible.

4. The wire harness assembly assist device as claimed in claim 1, further comprising an assembly screen information generating program for generating an assembly screen information displaying an attachment position of a mating component to be assembled with the component, the display control program controlling display of the generated assembly screen information.

5. The wire harness assembly assist device as claimed in claim 4, further comprising a guide information acquiring program for acquiring a guide information to guide insertion of an electrical wire with a terminal to a hole of an associated connector when the component includes the electrical wire and the connector, the assembly screen information generating program generating the assembly screen information displaying an electrical wire information of the electrical wire with the terminal superposed on the position of the insertion hole of the connector of an insertion hole position screen.

6. The wire harness assembly assist device as claimed in claim 5, further comprising an insertion detection program for detecting insertion of the electrical wire with the terminal into the insertion hole of the connector, the guide screen information generating program generating the assembly screen information displaying the electrical information superposed on the insertion hole position screen so that a visible distinction between the detected inserted electrical wire and the electrical wire to be inserted is possible.

7. The wire harness assembly assist device as claimed in claim 1, further comprising a shortage information input program for inputting a shortage information indicating a position of shortage of the component on the layout screen, and a shortage information memory program for storing the inputted shortage information.

8. A wire harness assembly assist unit comprising the wire harness assembly assist device as claimed in claim 1 and a display device for displaying the guide screen information in response to control of the display control program of the wire harness assembly assist device.

9. A method of assisting assembly of a wire harness with a component on a wiring board, the method comprising the steps of:

acquiring a layout information of the wire harness to be wired on the wiring board;

acquiring a component information corresponding to the component to be attached on the wiring board;

acquiring an attachment position information displaying an attachment position of the component on the wiring board;

generating a guide screen information displaying the acquired component information superposed on the acquired attachment position of the layout screen based on the acquired layout information and the acquired attachment position information; and displaying the generated guide screen information.

* * * * *